US006065821A

United States Patent [19]

Anderson et al.

[11] Patent Number: 6,065,821

[45] Date of Patent: May 23, 2000

[54] VERTICALLY ADJUSTABLE SHELF AND SUPPORT RAIL ARRANGEMENT FOR USE IN A CABINET

[75] Inventors: Ronald K. Anderson, Galesburg; David Brown; James E. deBeers, both of Chicago; Sheldon W. Mandel, East Galesburg; Mark P. Slaven, Chicago, all of Ill.

[73] Assignee: Maytag Corporation, Newton, Iowa

[21] Appl. No.: 09/079,357

[22] Filed: May 15, 1998

[51] Int. Cl.[7] ..... A47B 57/00

[52] U.S. Cl. ..... 312/408; 108/108; 211/187; 248/292.12

[58] Field of Search ..... 312/126, 128, 312/404, 408, 312, 410, 306, 350, 351, 247, 132, 319.5, 319.6, 319.7, 319.8; 108/106, 107, 108, 147, 147.11, 147.17, 20, 110; 211/90.02, 187, 208; 248/244, 241, 292.12, 295.11

[56] References Cited

U.S. PATENT DOCUMENTS

| | | | |
|---|---|---|---|
| 984,857 | 2/1911 | Schuftan | 108/106 |
| 1,080,230 | 12/1913 | Purssell . | |
| 1,145,383 | 7/1915 | McWilliams . | |
| 1,307,610 | 6/1919 | Yeagley | 248/244 |
| 1,676,108 | 7/1928 | Novak . | |
| 1,699,710 | 1/1929 | Pearlman . | |
| 2,002,339 | 5/1935 | Copeman . | |
| 2,555,254 | 5/1951 | Stebbins . | |
| 2,564,831 | 8/1951 | Butkus . | |
| 2,829,022 | 4/1958 | Lewis . | |
| 2,836,305 | 5/1958 | Davey et al. . | |
| 2,841,459 | 7/1958 | Sharpe . | |
| 3,172,715 | 3/1965 | Powder . | |
| 3,316,044 | 4/1967 | Carbary . | |
| 3,337,283 | 8/1967 | Schlenkert . | |
| 3,360,322 | 12/1967 | Hanifan . | |
| 3,933,102 | 1/1976 | Brunette | 108/107 |
| 3,982,801 | 9/1976 | Heidorn et al. . | |
| 4,026,222 | 5/1977 | Mueller . | |
| 4,221,443 | 9/1980 | Heaney | 312/306 |
| 4,329,928 | 5/1982 | Shaw . | |
| 4,619,208 | 10/1986 | Kurrasch | 108/106 X |
| 5,199,778 | 4/1993 | Aoki et al. . | |
| 5,441,416 | 8/1995 | Gajewski et al. . | |
| 5,799,588 | 9/1998 | Engel | 108/108 |

FOREIGN PATENT DOCUMENTS

| | | | |
|---|---|---|---|
| 1312569 | 11/1961 | France | 108/152 |

*Primary Examiner*—Janet M. Wilkens
*Attorney, Agent, or Firm*—Everett G. Diederiks, Jr.

[57] ABSTRACT

An adjustable shelf is able to be initially attached to support structure within a storage area of a cabinet at any one of a multitude of vertical heights and then can be readily, mechanically adjusted to reposition the shelf as desired. In one embodiment, the shelf includes a pair of sprockets which are interengaged with mating slots formed in a pair of similarly constructed and laterally spaced support rails positioned within the cabinet. The drive arrangement for the sprockets can be manually, electrically or otherwise driven to provide infinite adjustments for the vertical shelf. When an electrical power motor is utilized as the drive source, the motor is preferably mounted upon a frame of the shelf and electrical power is transmitted to the motor through, at least in part, the support rail structure. In addition, the adjustable shelf carries at least one shift limiting member that can be positioned in either an in-use position, wherein the shift limiting member assures that the sprockets are maintained in engagement with the support rails, or in a release position, wherein the shelf can be either removed from or mounted upon the rails. In addition, the support rails are preferably constructed to accommodate various types of shelves in order to present a more universal, overall shelving assembly.

33 Claims, 7 Drawing Sheets

VERTICALLY ADJUSTABLE SHELF AND SUPPORT RAIL ARRANGEMENT FOR USE IN A CABINET

BACKGROUND OF THE INVENTION

1. Field of the Invention

The present invention pertains to the art of cabinets and, more particularly, to a vertically adjustable shelf and support rail arrangement for use in a cabinet.

2.Discussion of the Prior Art

In order to accommodate varying sized items to be stored within a cabinet, it is desirable to provide a versatile shelving assembly that will enable shelves to be supported at heights that can be varied as desired. The advantages of providing a vertically adjustable shelving arrangement is particularly prevalent in refrigerator cabinets wherein the storage space between various vertically arranged shelves often needs to be adjusted to accommodate different food items. Typically, vertically adjustable shelving arrangements for cabinets only enable each shelf thereof to be fixedly mounted at a selected height and to only be repositioned vertically by completely disengaging the shelf from within the cabinet and again mounting the shelf in a new, fixed position. Repositioning a shelf in this manner generally requires all of the items stored upon the shelf to be removed prior to the vertical adjustment being performed. Of course, this can represent a rather time consuming and tedious project that must be performed even if it is desired to only adjust the shelf vertically a small distance. To alleviate this problem, it has heretofore been proposed to mount a shelf within a cabinet, such as a refrigerator cabinet, through a mechanism which will allow the shelf to be mechanically repositioned without having to first take the shelf out of the cabinet or to completely remove items stored thereon. Such types of known shelving arrangements have incorporated both manual and electrically powered adjustment mechanisms.

Unfortunately, vertically adjustable shelving arrangements for cabinets of this type proposed in the prior art have associated therewith various drawbacks. For instance, such known shelving arrangements typically require portions of the cabinet storage space to be individually designed for use with either fixed shelves or shelves which can be adjusted vertically without being completely removed from the cabinet. Therefore, predetermined areas are designated for mounting of the readily, vertically adjustable shelves, instead of providing an arrangement which is more versatile and which allows the readily adjustable shelf to be mounted in any one of a desired number of positions relative to other shelves within the cabinet.

Typically, these known readily adjustable shelves have associated therewith vertically extending guide screws, racks or channels which mandate that the shelves be initially mounted within the cabinet at a specified height and then repositioned as desired. For example, known shelving arrangements of this type often require the shelf to be initially mounted at an uppermost portion of the cabinet and then shifted downward to a desired height. With this construction, removal of the shelf also requires locating the shelf in this uppermost position. Of course, in initially mounting or removing the readily adjustable shelf, any intermediate shelves would have to be correspondingly removed if obstructing the path of the readily adjustable shelf. Therefore, these known shelving arrangements suffer from the disadvantage of not being able to initially attach the shelf in a wide range of positions or to readily remove the shelf without affecting the remainder of the overall shelving arrangement.

Based on the above, there exists a need in the art for a readily, vertically adjustable shelving assembly that can be easily mounted or removed at substantially any desired location within a cabinet, while still enabling the shelving assembly to be vertically repositioned through a reliable mechanical drive arrangement. In addition, there exists a need for a shelving assembly of this type which includes shelf supports that are more universal in nature so that they can support various types of shelves, thereby providing a more versatile overall shelving arrangement.

SUMMARY OF THE INVENTION

The present invention pertains to an adjustable shelving assembly for a cabinet which incorporates a pair of support rails adapted to be positioned in a laterally spaced, generally vertically extending configuration within the cabinet and which are designed for use in supporting various types of interchangeable shelves, including a shelf that can be readily or vertically shifted along the rails through the use of a drive mechanism. In a preferred form of the invention, each of the support rails includes first and second rail sections that are arranged juxtaposed to one another, with each of the first rail sections being adapted to support a fixed shelf in a cantilevered manner and each of the second rail sections being adapted to engage drive members of a mechanically driven, vertically adjustable shelf. In this manner, a single type of support rail arrangement can be produced and used to support shelves of varying construction within a single cabinet.

In further accordance with the present invention, the vertically adjustable shelf can be selectively shifted, through the use of a drive mechanism, to assume a substantially infinite number of vertical positions within a storage area of the cabinet. In addition, the vertically adjustable shelf can be initially mounted at a multitude of positions within the storage area of the cabinet, including positions intermediate upper and lower shelves, without having to remove or reposition the other shelves in the cabinet. Removal of the vertically adjustable shelf is also readily accommodated.

In accordance with preferred embodiments of the invention, the readily adjustable shelf is provided with a pair of rotatably mounted rear sprocket members that are interengaged with sections of the laterally spaced support rails and a driving mechanism is provided to rotate the sprockets in order to vertically adjust the shelf within the cabinet. The driving mechanism can be powered in various ways, including through manual and electric power sources. When electrically powered, a drive motor for the sprockets is mounted to a frame of the shelf and an AC power source is preferably routed to the motor, at least in part, through the support rail arrangement. The adjustable shelf also carries elements which ensure that the sprockets will not become disengaged from the rails while the shelf is mounted within the cabinet and used to support items thereon.

Therefore, the present invention is directed to a shelving arrangement that enables an infinitely adjustable shelf to be mounted or removed upon rails at any initial vertical height within the storage area of a cabinet and to be mechanically re-positioned without requiring the removal of food items placed thereon. Additional objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
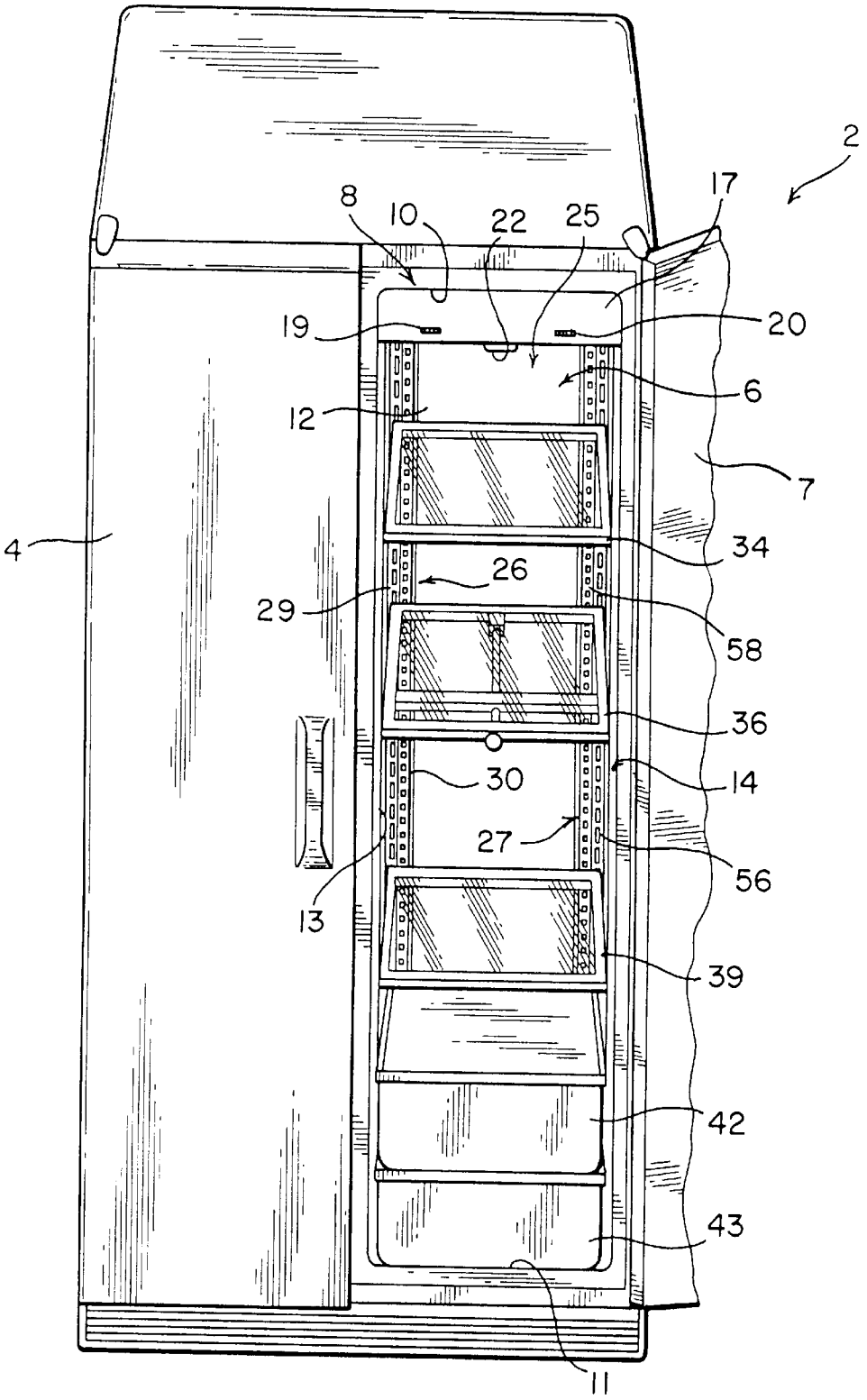
FIG. 1 is a front perspective view of a side-by-side refrigerator cabinet incorporating the adjustable shelving assembly of the present invention.

With initial reference to FIG. 1, a refrigerator cabinet incorporating an adjustable shelving assembly constructed in accordance with the present invention is generally indicated at 2. As shown, refrigerator cabinet 2 includes a freezer compartment that is sealed by a door 4 and a fresh food compartment 6. Of course, fresh food compartment 6 would also be provided with a corresponding door which is partially shown at 7. In general, fresh food compartment 6 is defined by a liner 8 mounted within refrigerator cabinet 2, with liner 8 being formed by integrally molded top, bottom, rear and side walls 10–14 respectively. For the sake of completeness, FIG. 1 illustrates the mounting of an upper temperature control panel 17 that is provided with multiple dials 19 and 20 for use in manually regulating the temperature maintained in both compartments of refrigerator cabinet 2. In addition, control panel 17 has associated therewith a light housing 22 for illuminating fresh food compartment 6 when the compartment is accessed.

The present invention particularly pertains to a versatile shelving assembly 25 that is shown mounted within fresh food compartment 6 for exemplary purposes. Therefore, although shelving assembly 25 of the present invention is shown for use in side-by-side refrigerator cabinet 2, it should be readily understood that shelving assembly 25 could be utilized in various other types of cabinets, including top mount style refrigerators, without departing from the spirit of the invention.

In general, shelving assembly 25 of the invention includes a pair of support rails 26 and 27 which are mounted within fresh food compartment 6 in a laterally spaced, generally vertically extending configuration. Each rail 26, 27 includes a first rail section 29 and a second rail section 30, with second rail section 30 being juxtapose and generally parallel to first rail section 29 as clearly shown in this figure.

The shelving assembly 25 of the present invention is intended to be versatile in nature and therefore rails 26 and 27 can be used to selectively support various types of shelves as will be detailed further below, with rails 26 and 27 being preferably, identically constructed. Although the particular number and design of the shelves incorporated in shelving assembly 25 can vary in accordance with the invention, FIG. 1 illustrates the mounting of a fixed cantilevered shelf 34, a vertically adjustable shelf 36, a second fixed cantilevered shelf 39 and a pair of lower, slidable bins 42 and 43 within fresh food compartment 6 of refrigerator cabinet 2. At this point, it should be recognized that the construction of fixed cantilever shelves 34 and 39 and slidable bins 42 and 43 are known in the art and therefore do not actually constitute part of the present invention. Instead, the invention is particularly directed to the construction and mounting of vertically adjustable shelf 36, as well as the construction of rails 26 and 27 which can be used to support the different types of known shelves and bins, as well as the newly proposed vertically adjustable shelf 36.

Figure 2:
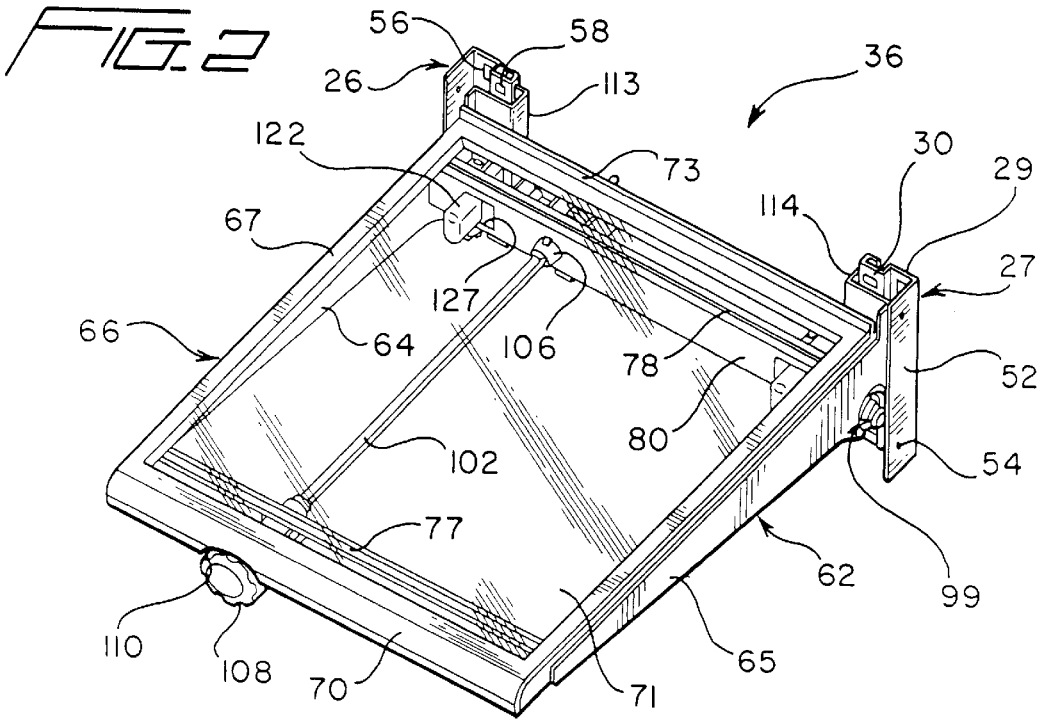
FIG. 2 is an upper right perspective view of an adjustable shelving assembly, according to a first embodiment of the invention, incorporated in the refrigerator cabinet of FIG. 1.
Figure 3:
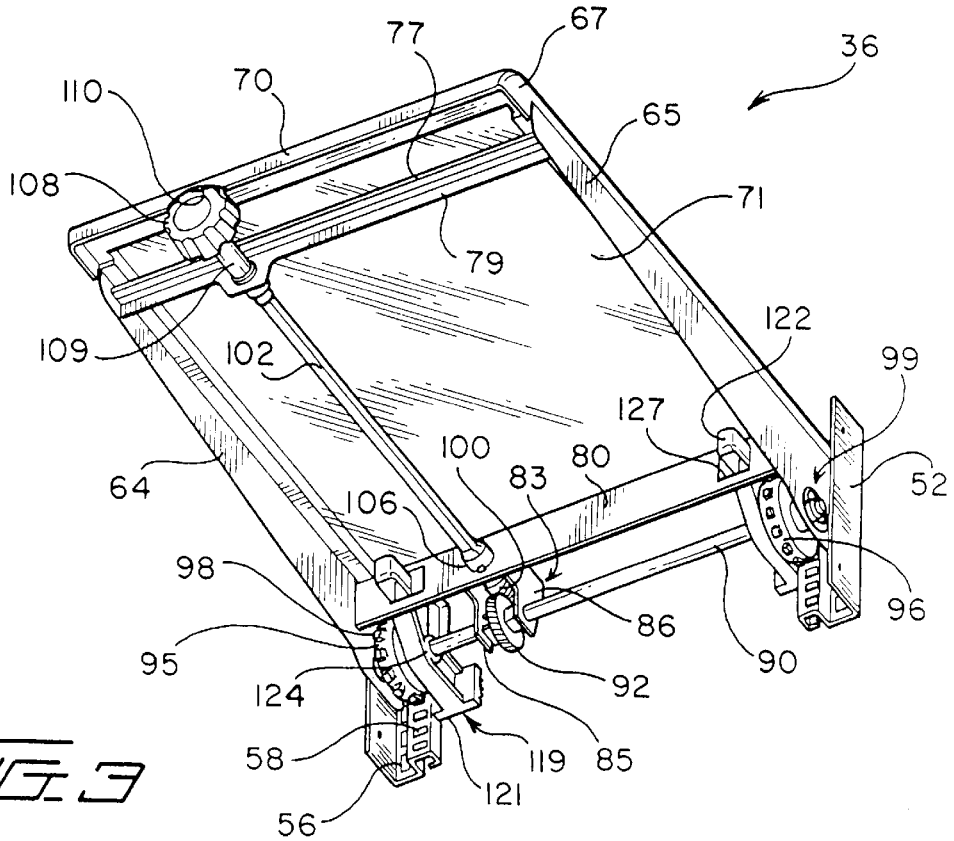
FIG. 3 is a lower right perspective view of the shelving assembly of FIG. 2.
Figure 4:
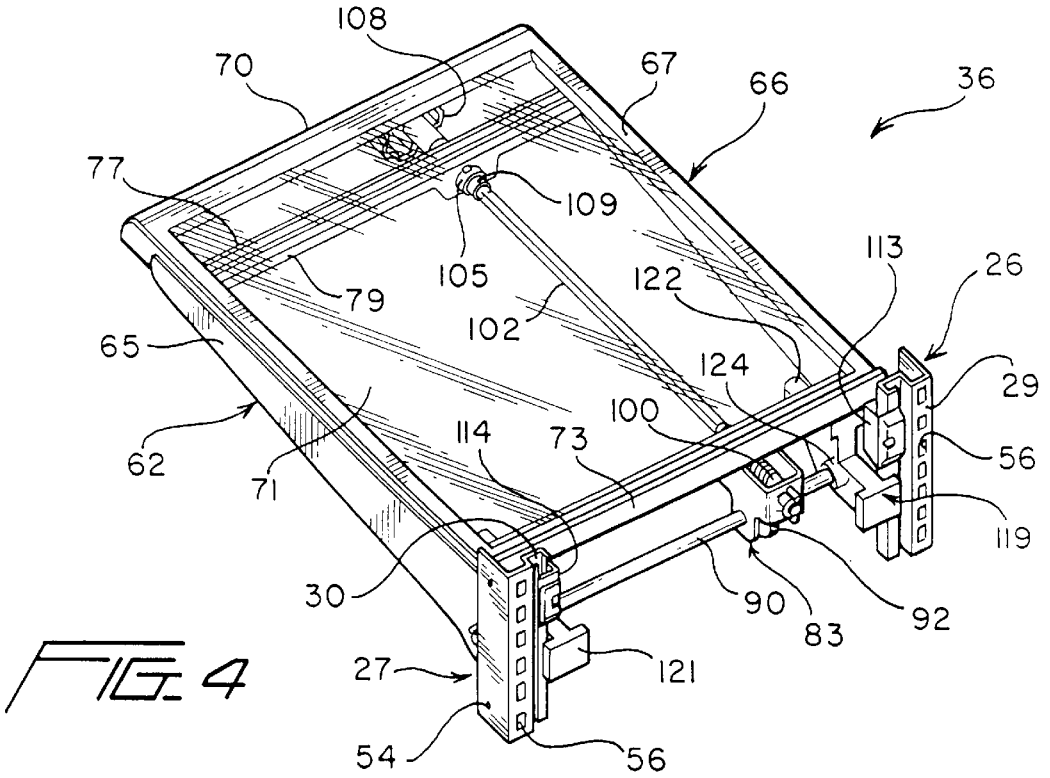
FIG. 4 is an upper rear perspective view of the shelving assembly of FIG. 2.

Reference will now be made to FIGS. 2–4 in describing a preferred embodiment for vertically adjustable shelf 36 and the preferred construction of rails 26 and 27. As clearly shown in these figures, each of the first and second rail sections 29 and 30 are generally U-shaped in cross-section, with the U-shape of the second rail section 30 being reversed with respect to that of first rail section 29. In the preferred embodiment, the first and second rail sections 29 and 30 are made from a single strip of metal in a roll-forming or equivalent process. Each of the rails 26, 27 also includes, in the preferred embodiment, an integral side plate 52 that is provided with a plurality of longitudinally spaced apertures 54.

With this construction, each of the rails 26 and 27 is adapted to be mounted to one of side walls 13 and 14 respectively, and adjacent rear wall 12 of fresh food compartment 6. This mounting is preferably performed by simply utilizing mechanical fasteners, such as screws (not shown) that extend through apertures 54 and into side walls 13 and 14. At this point, it should be noted that other types of mounting arrangements could also be readily utilized, including securing rails 26 and 27 directly to rear wall 12 through similar mechanical fasteners while assuring some spacing between rear wall 12 and each of first and second rail sections 29 and 30. The use of the side plates 52 is preferred as it enables rails 26 and 27 to be easily mounted during the manufacturing of refrigerator cabinet 2 and also averts a direct visual line of sight to the mechanical fasteners utilized.

As clearly shown in each of FIGS. 1–4, the first rail section 29 of each of the rails 26 and 27 is formed with a plurality of vertically spaced and vertically elongated slots 56. On the other hand, the second rail section 30 of each of the rails 26 and 27 is preferably formed with a plurality of vertically spaced, horizontally elongated slots 58 (best shown in FIG. 3). It is through the use of slots 56 and 58 that the various types of shelves 34, 36, 39 etc. are attached to rails 26 and 27 and supported within fresh food compartment 6 in a cantilevered manner as further described below. As will become clearly evident hereinafter, it is due to the different configuration of slots 56 and 58 that various types of shelves can be mounted within fresh food compartment 6 by utilizing only a single, unitary construction for each of rails 26 and 27.

Prior to describing the manner in which vertically adjustable shelf 36 is supported upon rails 26 and 27, a first preferred construction of vertically adjustable shelf 36 will now be described, again referencing FIGS. 2–4. Vertically adjustable shelf 36 includes a frame 62 defined by fore-to-aft extending side members 64 and 65 which support an annular platform 66. As shown, platform 66 includes an annular rim 67 having a front extension piece 70 and a piece of glass 71. Preferably, the annular rim 67 is formed of plastic and is molded about the peripheral portion of glass 71. Shelf 36 also includes a rear spill guard 73. Although glass is preferred for use in platform 66, it should be recognized that other materials could also be utilized to simply define a generally horizontal planar support platform upon which food items can be placed within refrigerator cabinet 2.

Frame 62 also preferably includes a front crossbar 77, a rear crossbar 78, a vertically extending front cross plate 79 that is preferably defined by a bent portion of front crossbar 77, and a rear, vertically extending cross plate 80 that is preferably integral with rear crossbar 78. As perhaps best shown in FIG. 3, affixed to rear cross plate 80 is a generally U-shaped bracket 83 that includes a pair of laterally spaced, downwardly extending legs 85 and 86, each of which is provided with an aligned hole (not labeled). The aligned holes receive, for relative rotational movement, a driveshaft 90. Driveshaft 90 has secured for concurrent rotation therewith, at an intermediate portion defined between legs 85 and 86, a worm gear 92. Driveshaft 90 also has secured thereto, adjacent outer terminal end portions thereof, respective sprocket gears 95 and 96, each of which is provided with a plurality of circumferentially spaced and outwardly projecting teeth 98.

In the preferred embodiment, teeth 98 are elongated in the lateral direction and taper outwardly in the radial direction. The terminal ends of driveshaft 90 are also rotatably supported by side members 64 and 65 such as indicated at 99. Although not clearly shown in these figures for the sake of simplicity, it should be readily understood that each of the terminal ends of driveshaft 90 are supported at 99 by means of a journal (not labeled) mounted within an aperture formed in each of side member 64, 65. Of course, various alternative embodiments could also be utilized such as mounting a bushing sleeve or the like in the inner lateral side surface of each of side members 64 and 65 and positioning the terminal ends of driveshaft 90 herein. It is only important that the driveshaft 90 be supported by frame 62 for relative rotation about an axis defined by driveshaft 90 and that sprocket gears 95 and 96 rotate in unison with driveshaft 90.

Rotation of driveshaft 90 in accordance with the present invention is performed through worm gear 92. More specifically, a worm 100 is fixed to a terminal end portion of an adjustment rod 102. In the preferred embodiment, adjustment rod 102 is mounted for rotation relative to frame 62 by U-shaped bracket 83 and both front and rear cross plates 79 and 80. More specifically, front and rear cross plates 79 and 80 have mounted thereto respective snap-fit journals 105 and 106 which rotatably support adjustment rod 102. At an end of adjustment rod 102, remote from worm 100, is mounted a knob 108 which can be utilized to manually rotate adjustment rod 102. In the embodiment shown, adjustment knob 108 actually includes an integral sleeve 109 which non-rotatably receives the front end of adjustment rod 102 and knob 108 extends into an arcuate recess 110 formed in front extension member 70.

With this arrangement, it should be readily apparent that manual rotation of knob 108 will cause each of sprockets 95 and 96 to rotate in unison with driveshaft 90. More specifically, rotation of knob 108 causes adjustment rod 102 to simultaneously rotate. This rotational force is transferred through worm 100 to worm gear 92. As indicated above, worm gear 92 is fixed to driveshaft 90 such that the rotation of worm gear 92 will result in a commensurate rotation of driveshaft 90 and sprockets 95 and 96.

Frame 62 of vertically adjustable shelf 36 also includes a pair of laterally spaced, rear mounted channel members 113 and 114. In the preferred embodiment, each of the channel members 113 and 114 is generally U-shaped in cross-section with each of the channel members 113 and 114 opening laterally outwardly as clearly shown in FIGS. 2 and 4. With this construction, vertically adjustable shelf 36 can be advantageously, initially mounted upon rails 26 and 27 at any selected location between the terminal ends of rails 26 and 27. More specifically, vertically adjustable shelf 36 is mounted upon rails 26 and 27 by initially tilting a front portion of shelf 36 upward with respect to the horizontal and then rotating shelf 36 about a fore-to-aft extending central axis thereof in order to enable each of the U-shaped channel members 113 and 114 to extend about the second rail section 30 of a respective rail 26 and 27. The adjustable shelf 36 can then again be rotated until U-shaped channel members 113 and 114 are substantially located in a common horizontal plane. At this point, adjustable shelf 36 is tilted downward at the front end so that the teeth 98 of sprockets 95 and 96 become lodged in slots 58 formed in second rail sections 30 of rails 26 and 27 respectively.

As clearly illustrated in FIG. 2, there is both some lateral and fore-to-aft extending play between the U-shaped channel members 113 and 114 and the second rail sections 30 of rails 26 and 27 in order to accommodate this limited tilting of shelf 36. At this point, manual rotation of knob 108 will cause vertical shifting of adjustable shelf 36 through the rotation of sprockets 95, 96 and their interengagement with the respective second rail sections 30. This vertical shifting of adjustable shelf 36 can readily be performed in either direction. Therefore, adjustable shelf 36 can be moved closer to fixed cantilevered shelf 34 or fixed cantilevered shelf 39, as desired. Additional adjustable shelves 36 can also be utilized and, given the advantageous manner in which each adjustable shelf 36 can be interconnected with rails 26 and 27 at any desired position along the length of the rails 26 and 27, any shelves positioned above and/or below adjustable shelf 36 need not be removed in order to insert or remove the adjustable shelf 36 therebetween.

There may be some concern that external forces may act upon frame 62 which will cause the front end portion of adjustable shelf 36 to shift vertically, thereby dislodging teeth 98 from slots 58 and causing adjustable shelf 36 to drop vertically downward. For example, the manual lowering of shelf 36 through knob 108 could cause a food item supported upon lower shelf 39 to abut the front end portion of shelf 36. Continued lowering of shelf 36 could cause the front end portion to tilt upward, thereby dislodging teeth 98 from slots 58. To avoid this circumstance, the vertically adjustable shelf 36, constructed in accordance with the present invention, is provided with at least one shift limiting member 119. Actually, in the preferred embodiment, a pair of laterally spaced shift limiting members 119 are provided as clearly illustrated in these figures. Each shift limiting member 119 is defined by a brake element 121 that is adapted to extend behind the second rail section 30 of a respective rail 26, 27, a release element 122 and a central sleeve 124. Central sleeve 124 receives driveshaft 90 therethrough, with driveshaft 90 being permitted to rotate within central sleeve 124. Release element 122 of each shift limiting member 119 projects through a respective slot 127 formed in rear cross plate 80 which ensures that driveshaft 90 rotates relative to the shift limiting members 119.

In the preferred embodiment, each of the shift limiting members 119 are formed of plastic and are laterally shiftable along driveshaft 90. When shift limiting members 119 are in the positions shown in these figures, the forward end of vertically adjustable shelf 36 is prevented from being tilted upwardly an amount which would cause teeth 98 to become dislodged from slots 58. Instead, if the forwardmost portion of vertically adjustable shelf 36 was to be lifted upwardly, brake elements 121 would directly abut the rear of second rail sections 30 in order to limit the permissible degree of tilting. Therefore, if knob 108 was utilized to lower adjustable shelf 36 such that the forwardmost portion of shelf 36 was to abut one or more food items placed upon lower shelf 39, continued lowering of adjustable shelf 36 would merely cause brake elements 121 to engage second rail sections 30, thereby preventing disengagement between sprockets 95 and 96 and rails 26 and 27. On the other hand, if it is desired to remove adjustable shelf 36 from upon rails 26 and 27, release elements 122 need merely be shifted laterally inwardly within slots 127 such that brake elements 121 are arranged entirely within the confines of second rail sections 30. Repositioning brake elements 121 in this manner enables the forwardmost portion of adjustable shelf 36 to be tilted upwardly in order to disengage sprockets 95 and 96 from the second rail sections 30. Then, the entire adjustable shelf 36 can be rotated about a generally fore-to-aft extending axis to remove U-shaped channel members 113 and 114 from about second rail sections 30. The reverse operation would be performed to replace adjustable shelf 36 at any desired location between the terminal ends of rails 26 and 27 as discussed above.

At this point, the discussion of the present invention has focused on detailing the preferred construction of rails 26 and 27, as well as the manner in which shelf 36 is interengaged with rails 26 and 27 while being permitted to vertically shift within cabinet 2. These details of the invention have been made with reference to FIGS. 1–4 which illustrate platform 66 being fixed relative to side members 64 and 65 and two potential, laterally offset positions for knob 108. Although shelf 36 can include a fixed platform 66, a preferred embodiment of the invention actually enables platform 66 to slide relative to side members 64 and 65 in the fore-to-aft direction of cabinet 2. In the embodiment of FIGS. 2–4, this shifting of platform 66 can be readily accommodated with knob 108 remaining in a fixed position due to the formation of arcuate recess 110. However, a preferred construction of a slidable shelf that can be readily mounted within a cabinet at a desired vertical height and also adjusted vertically in accordance with the invention will be described below with reference to the embodiment of FIGS. 5–10.

In general, the embodiment of FIGS. 5–10 differ from the above-described embodiment in only a few respects. Therefore, the common structural elements between the two embodiments will not be reiterated here, but rather like reference numerals with primes have been used to refer to corresponding parts throughout these figures, e.g., reference numeral 65' refers to a side member corresponding to side member 65 of the first embodiment and reference numeral 102' refers to an adjustment rod corresponding to adjustment rod 102. The second embodiment therefore illustrates a shelf 36' having a platform 66' which is formed with an annular rim 67' that encapsulates a piece of glass 71'. In a manner analogous to the first embodiment of the invention, annular rim 67' includes a front extension piece 70'. Actually, this second embodiment illustrates another mechanism for adjusting the vertical position of shelf 36'. Therefore, in accordance with this second embodiment, front extension piece 70' is provided with a central cut-out 140. Arranged within central cut-out 140 is a crank assembly 142 that includes a transverse block 143 to which is pivotally mounted a crank handle 144. Transverse block 143 is preferably molded of plastic with an integral sleeve portion 146. Sleeve portion 146 is rotatably supported by a front cross plate 79' and drivingly receives adjustment rod 102.

Figure 5:
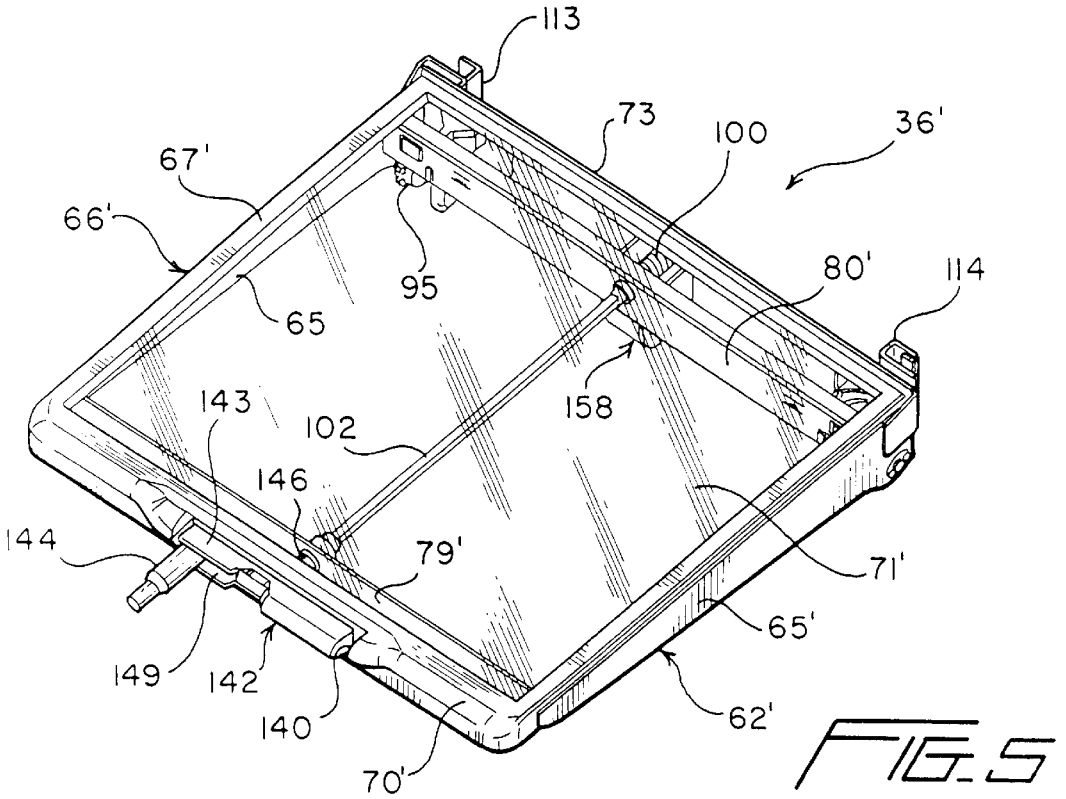
FIG. 5 is an upper right perspective view, similar to that of FIG. 2, illustrating a crank actuated, adjustable shelving assembly according to a second embodiment of the invention.
Figure 6:
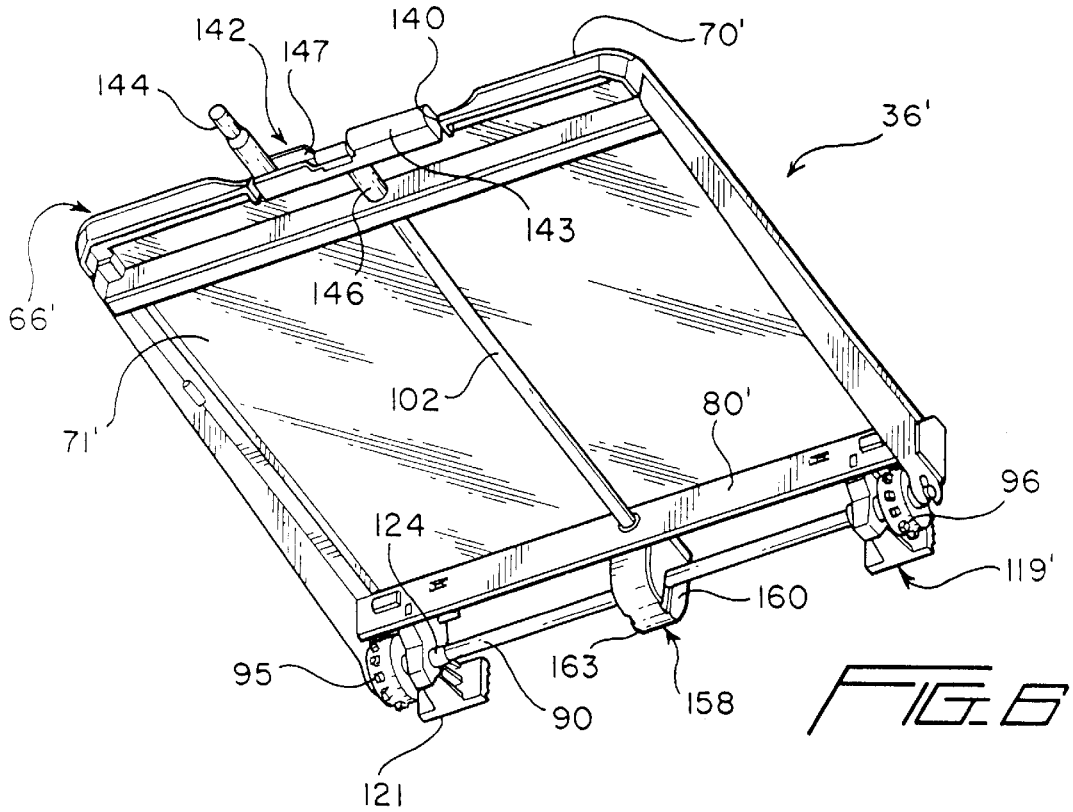
FIG. 6 is a lower right perspective view of the shelving assembly of FIG. 5.

As clearly shown in these figures, transverse block 143 is provided with a receiving slot 147 that is sized to accommodate pivotally mounted crank handle 144. More particularly, crank handle 144 is pivotally attached to transverse block 143 for movement between an in-use position as shown in FIGS. 5 and 6 and a retracted position illustrated in FIGS. 7 and 8. When platform 66' is fully retracted and assumes the position shown in FIGS. 5 and 6, crank handle 144 can be pivoted to the in-use position shown and used to manually rotate transverse block 143, sleeve portion 146 and adjustment rod 102 to either vertically raise or lower shelf 36' in a manner directly commensurate with that discussed above with respect to shelf 36. Except for the substitution of crank assembly 142 for knob 108 and the repositioning of adjustment rod 102 along a substantially central longitudinal axis of shelf 36', the transmission of torque from adjustment rod 102 to sprockets 95 and 96 in the second embodiment is identical to that already described above. Obviously, during use of crank assembly 142, transverse block 143 will rotate in a circular path that extends above and below platform 66'. For this reason, platform 66' must be fully retracted, such as shown in FIGS. 5 and 6, in order to vertically adjust shelf 36'.

Figure 9:
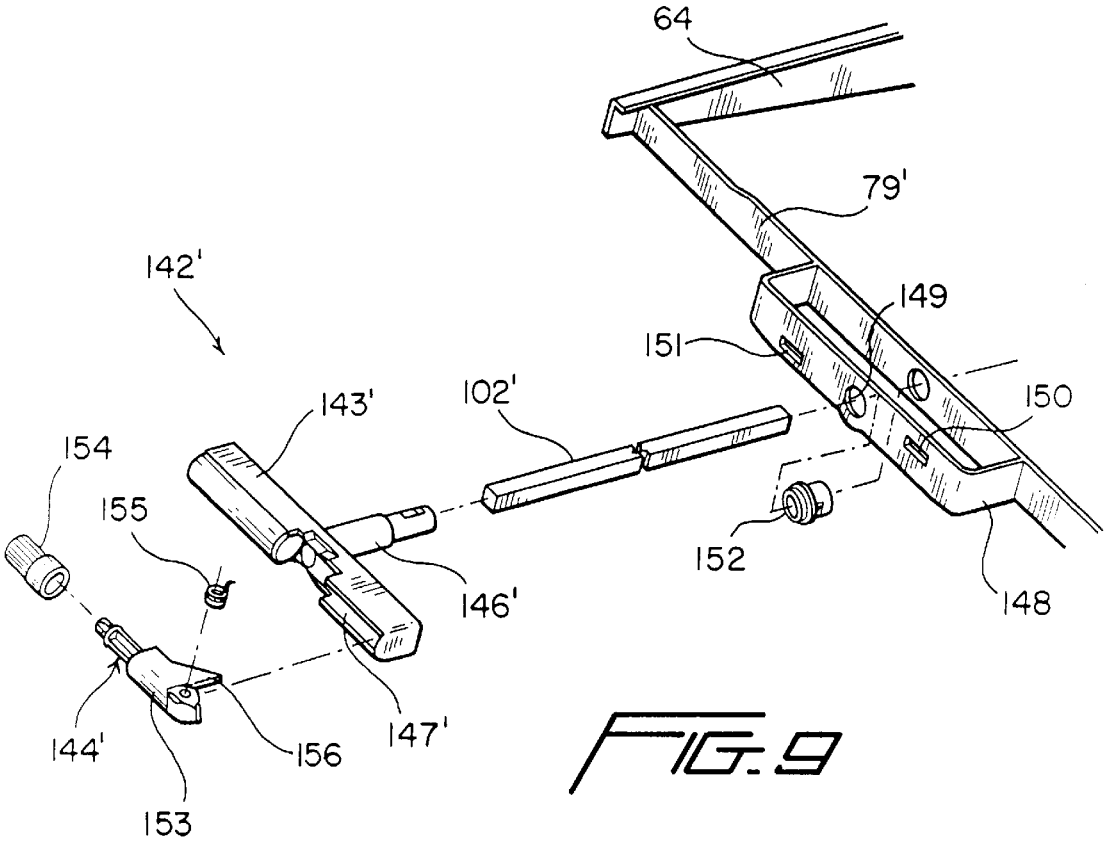
FIG. 9 is an exploded perspective view of a modified form of the crank mechanism of the shelving assembly of FIGS. 5–7.
Figure 8:
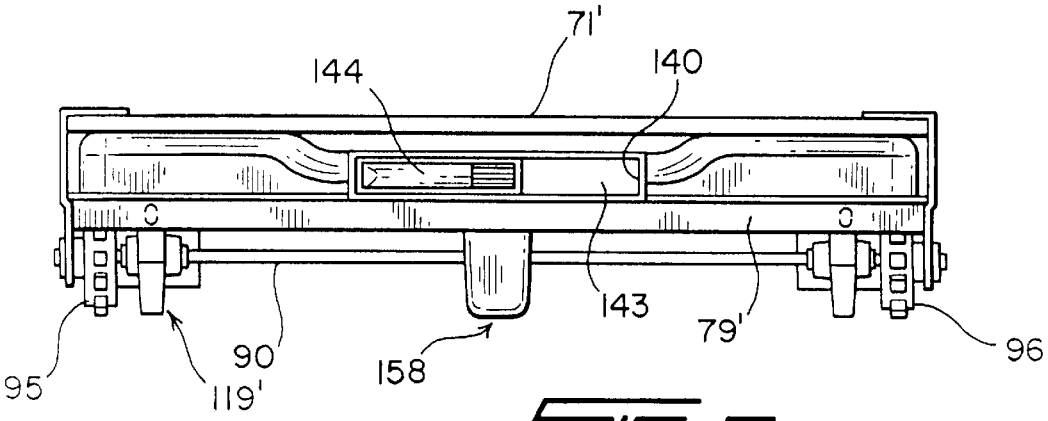
FIG. 8 is a front elevational view of the shelving assembly of FIGS. 5–7.

FIG. 9 actually illustrates a slightly modified crank assembly 142'. In accordance with this arrangement, a generally U-shaped handle bracket 148 extends forwardly from front cross plate 79' and is provided with an aperture 149 which further rotatably supports sleeve portion 146' of transverse block 143'. Handle bracket 148 is also formed with a pair of slots 150 and 151. In the preferred embodiment shown, slot 150 is arranged in a plane higher than slot 151 for the reason which will become apparent below. Crank assembly 142' further incorporates a spacer sleeve 152 that is arranged between handle bracket 148 and front cross plate 79'.

Crank assembly 142' also has an associated crank handle 144' which includes a handle extension piece 153 to which is rotatably attached, preferably in a snap-fit manner, a handle sleeve or spinner 154. Handle extension piece 153 is received within slot 147' associated with transverse block 143'. More specifically, handle extension piece 153 is pivotably mounted to transverse block 143' and is further biased by means of a spring 155 to a fully retracted position generally corresponding to that shown in FIGS. 7 and 8.

Of particular note is the formation of a tab 156 projecting from handle extension piece 153. Actually, in the preferred embodiment, handle extension piece 153 and tab 156 are integrally formed of plastic. In any event, tab 156 is adapted to be received in one of slots 150 or 151, depending upon the angular rotation of transverse block 143', when handle extension piece 153 and handle sleeve 154 are retracted within receiving slot 147'. Therefore, tab 156 functions to lock crank handle 144' in a horizontal position so as to assure that crank assembly 142' will not obstruct the sliding of platform 66', undesirable vertical movement of shelf 36', even under heavy loading, cannot occur and an enhanced overall aesthetic appearance of the shelving system is provided. Of course, it should be apparent that other structure could also be utilized to perform the function of tab 156 and slots 150 and 151 without departing from the spirit of the invention. In addition, corresponding or similar structure could be utilized in connection with the embodiment of FIGS. 1–4. For example, knob 108 could be provided with a rearwardly projecting tab which could be selectively received in a slot or notch of the shelf frame to perform this function, with knob 108 being pushed into a locking position and pulled slightly out to enable rotation thereof.

In accordance with the present invention, rather large torque loads can exist between worm gear 92 and worm 100. More particularly, due to the fact that the weight of items placed upon either shelf 36 or 36' will tend to cause sprockets 95 and 96 to rotate and undesirably shift the set position of the shelf, worm gear 92 can transmit substantial torque loads upon worm 100. In any event, due to the inherent nature of such worm drive assemblies and the arrangement of tab 156 in a respective one of slots 150 or 151, this torque cannot force worm 100 to rotate but it certainly does place a load on the elongated helical tooth thereof. To assure adequate operation of this drive assembly, it is therefore necessary to maintain rather tight tolerances between the meshed worm gear 92 and worm 100. This function is performed by U-shaped bracket 83 preferably formed of metal in the first embodiment. In the second embodiment, tight tolerances are established by positioning these gears within a plastic gear housing 158. Therefore, as opposed to utilizing the generally U-shaped bracket 83 of the first embodiment, a plastic gear housing 158, which can be manufactured to extremely tight tolerance ranges at a reasonable cost, is provided in accordance with the second embodiment. As shown, plastic gear housing 158 includes slotted side members 160 which receive driveshaft 90, as well as upper and lower cover portions 162 and 163. In this manner, plastic gear housing 158 essentially encapsulates worm gear 92 and worm 100 as clearly shown in these figures.

Figure 7:
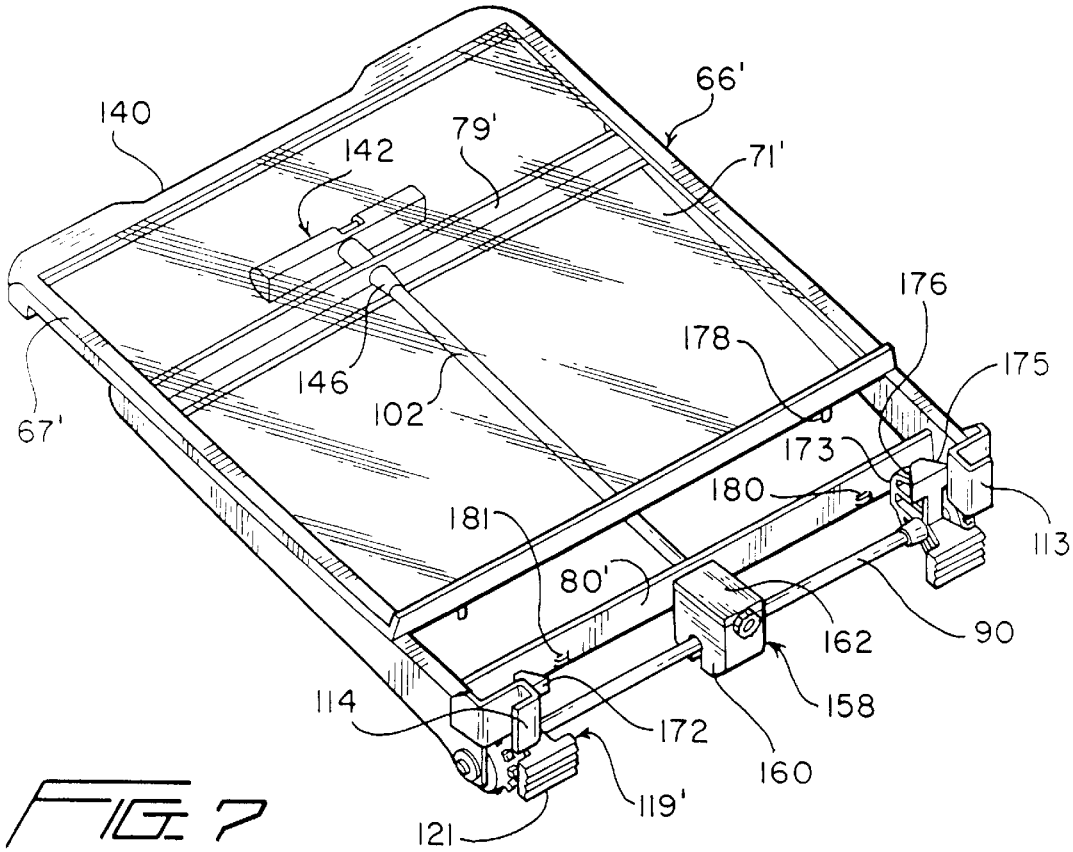
FIG. 7 is an upper rear perspective view of the shelving assembly of FIG. 5 in an extended condition.

The embodiment of FIGS. 5–10 also differs from the first embodiment in the exact construction of shift limiting members 119'. As best shown in FIGS. 7, 10*a* and 10*b*, shift limiting members 119' still rotatably receive driveshaft 90 and incorporate brake elements 121. However, each shift limiting member 119' is no longer provided with a corresponding release element 122 and therefore rear cross plate 80' is formed without corresponding slots 127. At this point, it should be realized that this design for shift limiting member 119' could also be used with the embodiment of FIGS. 2–4. In any event, each shift limiting member 119' includes an upper portion 172 and a front abutment portion 173. Front abutment portion 173 is adapted to be positioned directly adjacent a rear surface of rear cross plate 80' in order to prevent rotation of shift limiting member 119', while still accommodating lateral shifting thereof along driveshaft 90. In addition, upper portion 172 is provided with camming surfaces 175 and 176. Camming surfaces 175 and 176 are adapted to cooperate with respective shifting projections, one of which is indicated at 178 in FIG. 7, that are integrally molded as part of platform 66' and project downward from annular rim 67' a distance which avoids interference with rear cross plate 80' during fore-to-aft shifting of platform 66' relative to frame 62'. However, upon sliding of platform 66' in the aft direction within cabinet 2, each projection 178 will engage a respective camming surface 175, 176 to assure that shift limiting members 119' are positioned in a manner wherein each brake element 121 is arranged behind a respective second rail section 30.

Figure 10A:
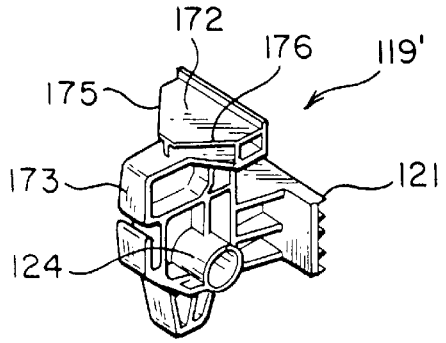
FIG. 10*a* is a right perspective view of a shift limiting member utilized in the shelving assembly of FIGS. 5–7.
Figure 10B:
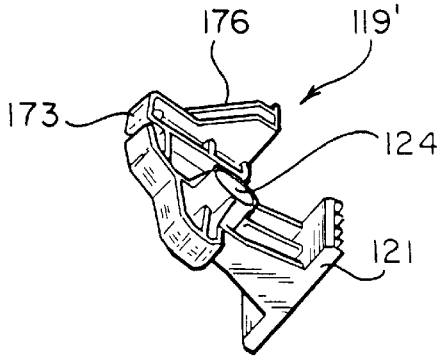
FIG. 10*b* is a lower right perspective view of the shift limiting member of FIG. 10*a;*

Based on the above, in order to mount or remove adjustable shelf 36' within cabinet 2, platform 66' must be shifted forward at least an amount which will enable each shift limiting member 119' to be manually moved along driveshaft 90 until each brake element 121 is no longer arranged behind a respective rail 26, 27. The lateral inward movement of the shift limiting members 119' is preferably limited by means of respective stops 180 and 181 provided along rear cross plate 80'. In the preferred embodiment, stops 180 and 181 are simply stamped from rear cross plate 80'. Of course, in order to shift platform 66' forward, crank assembly 142 must be properly positioned with transverse block 143 arranged in a substantially horizontal plane as shown in FIGS. 5–8. With this construction, if shelf 36 is initially mounted within cabinet 2, rearward sliding of platform 66' will cause shift limiting members 119' to be automatically shifted laterally outwardly due to the interengagement between each shifting projection 178 and the respective camming surface 175, 176. Obviously, only a single camming surface 175, 176 is utilized for this purpose on each of the left and right sides of shelf 36'. FIGS. 10*a* and 10*b* show both camming surfaces 175 and 176 on each shift limiting member 119' given that a symmetrical part is illustrated for use on either side of the shelf 36'. However, it should be also understood that mirror image parts could equally be utilized. In this case, if brake element 121 extends to the right of the part, only a left extending cam surface 175 or 176 is provided and vise versa.

At this point, it should be realized that the basic construction of shelf 36' which accommodates the sliding movement of platform 66' relative to frame 62' is known in the art and not considered part of the present invention. In fact, slidable shelves mounted in a fixed cantilevered manner upon rails within a refrigerator have been in production for quite some time. Of course, platform 66' must accommodate crank assembly 142 and therefore such known slidable shelves would need to be modified to incorporate central cut-out 140, or arcuate recess 110 for the first embodiment, for use in the present invention.

Figure 11:
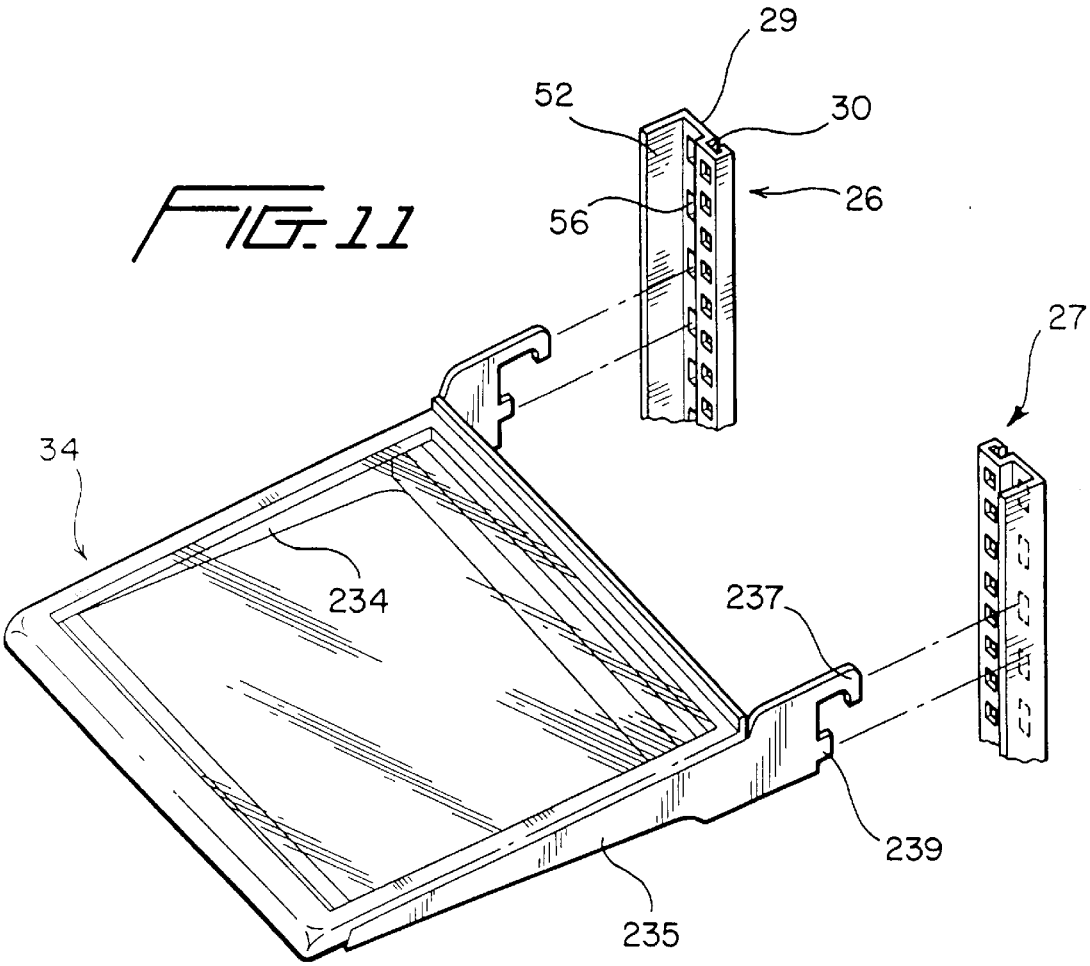
FIG. 11 is an exploded view of a cantilevered shelf and rail arrangement incorporated in the overall shelving assembly depicted in the refrigerator cabinet of FIG. 1.

FIG. 11 illustrates a preferred construction for fixed cantilevered shelf 34 and the manner in which shelf 34 is attached to rails 26 and 27. In general, the construction of shelf 34 is known in the art and does not form part of the present invention. However, for the sake of completeness, it should be recognized that shelf 34 includes side members 234 and 235, each of which terminates, at the rear terminal ends thereof, in an upper hook portion 237 and a lower tab 239. The hook portion 237 and tab 239 of each of the side members 234 and 235 are adapted to be received within respective slots 56 formed in a respective first rail section 29 in order to support shelf 34 in a cantilevered manner upon rails 26 and 27. Again, this manner of supporting a fixed cantilevered shelf within a refrigerator or other cabinet is generally known in the art. However, FIG. 5 illustrates this manner of attaching cantilevered shelf 34 in order to emphasize the particular construction of rails 26 and 27 in accordance with the present invention. More particularly, rails 26 and 27 are constructed so as to not only enable conventional cantilevered shelves, such as shelf 34, to be mounted thereon at first rail sections 29, but to also enable one or more vertically adjustable shelves 36 or 36' to be mounted thereon at second rail sections 30. Therefore, a single type of rail arrangement is provided in accordance with the present invention which enables various different types of shelves to be supported therefrom, preferably in a cantilevered manner within a cabinet.

Figure 12:
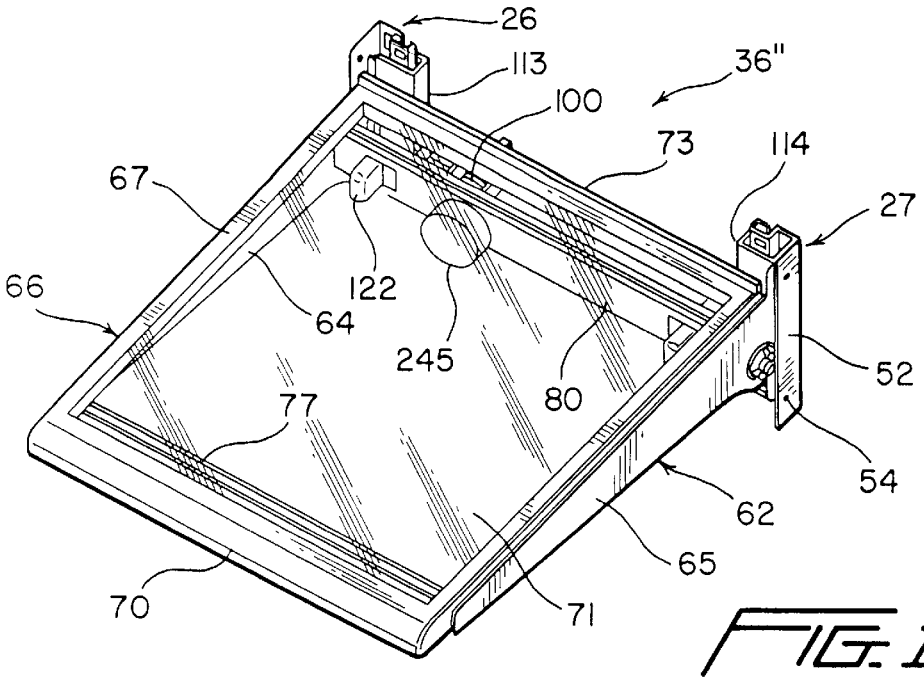
FIG. 12 is an upper perspective view of a third embodiment of the adjustable shelving assembly of the present invention.

FIG. 12 illustrates a third embodiment of a vertically adjustable shelf 36" which differs only from vertically adjustable shelf 36 in the manner in which the shelf 36" is driven vertically upward or downward. Due to the similarity between the constructions of the shelves 36 and 36", like reference numerals have been utilized and only the differences between the two shelves will be detailed here. In accordance with this embodiment, shelf 36" carries an electric motor 245 that is secured to rear cross plate 80 and is used to drive worm 100. Motor 245 preferably constitutes a reversible motor that can be actuated to drive shelf 36" either upward or downward along rails 26 and 27 by means of a multi-directional switch (not shown) mounted on shelf 36". More importantly, with respect to the present invention, is the manner in which electrical power is delivered to motor 245. A battery source mounted on the frame 62 of shelf 36" could be utilized to power motor 245. Of course, the battery would have to be periodically replaced or recharged. Instead, AC power could be transmitted to motor 245. Since motor 245 is attached for vertical movement with frame 62, the manner of transmitting AC power to motor 245 is limited.

Figure 13:
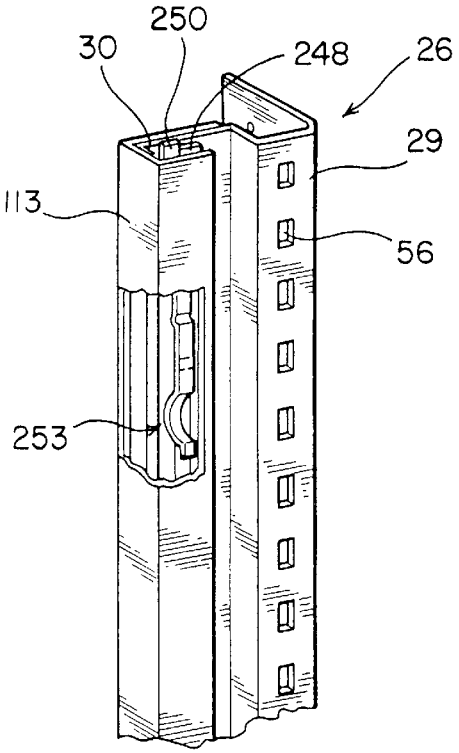
FIG. 13 is a partial cut-away view of a power transfer arrangement incorporated in the adjustable shelving assembly embodiment of FIG. 12.
Figure 14:
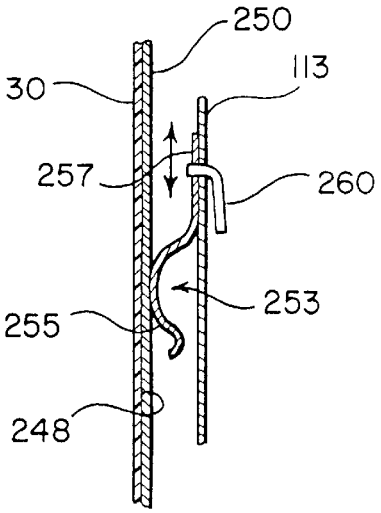
FIG. 14 is a partial cross-sectional view of the power transfer arrangement of FIG. 13.

Although direct wires could extend along rear wall 12 and perhaps even be associated with a reeling device to remove slack therefrom upon shifting of shelf 36", such an arrangement would likely be considered unsightly and/or costly. Therefore, in accordance with a preferred embodiment of the present invention, it is desired to transmit power to motor 245 through one or more of rails 26 and 27. More specifically, as best illustrated in FIGS. 13 and 14, the preferred embodiment provides, on a rear surface 248 of each second rail section 30, an elongated power transmitting strip or bus bar 250. Since each second rail section 30 is fixed relative to cabinet 2, each bus bar 250 can be readily attached to an electrical power source or, conversely, grounded. Furthermore, a contact 253 is provided within each of the U-shaped channel members 113 and 114 in order to be in electrical contact with a respective bus bar 250. As best shown in FIG. 14, each contact 253 preferably includes an arcuate portion 255 that is placed in direct contact with bus bar 250 and a generally flat portion 257 that is attached to a respective channel member 113, 114. A wire lead 260 extends from flat portion 257 of each contact 253 directly to motor 245. Since the channel members 113 and 114 shift vertically with frame 62, a fixed length for each lead 260 can be utilized and the lead 260 can be easily mounted in an unobtrusive manner upon frame 62. Furthermore, it should be realized that the electrical power can be used for other purposes, such as illuminating a light (not shown) on shelf 36".

Based on the above, it should be readily apparent that the vertically adjustable shelving assembly of the present invention can be shifted either manually through the use of a knob 108 in the embodiment of FIGS. 2–4, through crank assembly 142 in the embodiment of FIGS. 5–8, or through the use of an electric motor 145 in the embodiment of FIGS. 12–14. Of course, other arrangements could be equally incorporated in the overall driving mechanism of the present invention, such as utilizing a releasable one-way clutch or ratchet within the drive path, without departing from the spirit of the invention. In any case, it is preferable to drive sprockets 95 and 96 through worm 100 since such a drive arrangement has the inherent characteristics that the worm gear cannot be driven in a reverse direction by worm gear 92. Therefore, any weight placed upon shelf 36, 36' or 36" cannot force drive shaft 90 to undesirably rotate as the worm gear arrangement will only permit drive in one direction, i.e., input rotation has to come from worm 100. Again, this is an inherent characteristic in worm gear drive systems which is advantageously utilized for this particular purpose.

Therefore, although described with respect to preferred embodiments of the present invention, it should be readily understood that various changes and/or modifications can be made to the invention without departing from the spirit thereof. More particularly, although a particular rail configuration, a particular manner in which a vertically adjustable shelf 36, 36' or 36" can be mounted upon rails 26 and 27 at a multitude of positions between the terminal ends of the rails, a particular brake/shift limiting arrangement and a preferred electrical power transfer system has been disclosed, various other arrangements which perform these functions will be readily apparent to one of ordinary skill in the art once the present disclosure is read and understood. For instance, the first end section rail sections 29 and 30 need not be laterally offset as shown in the preferred embodiment, but could be arranged juxtapose one another in other ways, including alternating along a single vertical rail section or even intersecting along a single rail section given that slots 56 and 58 preferably extend perpendicular to each other. In any event, the above description is not intended to be limiting to the invention, but merely illustrative and the invention is only intended to be limited by the scope of the following claims.

We claim:

1. An adjustable shelving assembly for a cabinet comprising:

a pair of support rails adapted to be positioned in a laterally spaced, generally vertically extending configuration within the cabinet, each of the support rails having terminal end portions and an associated longitudinal axis;

a shelf including a frame adapted to support a platform in a generally horizontal plane, with the shelf having fore-to-aft spaced, first and second end portions;

means for connecting the second end portion of the shelf upon said rails while permitting longitudinal movement of the shelf along the rails, said connecting means enabling the shelf to be initially engaged with said rails at a multitude of positions between the terminal end portions of said rails; and a mechanism for longitudinally shifting the shelf along the rails, without entirely disconnecting the second end portion of the shelf from the rails, to selectively adjust the vertical position of the shelf within the cabinet.

2. The adjustable shelving assembly according to claim 1, wherein the connecting means includes a pair of channel defining members secured to the second end portion of the shelf, each of the channel defining members extending about a portion of a respective one of the rails.

3. The adjustable shelving assembly according to claim 2, wherein the connecting means also includes a pair of laterally spaced sprockets rotatably supported by the second end portion of said shelf, with each of said sprockets being engageable with a respective one of the rails to interengage the shelf and the rails while permitting longitudinal movement of the shelf along the rails upon rotation of said sprockets.

4. The adjustable shelving assembly according to claim 3, wherein said mechanism for longitudinally shifting the shelf along the rails includes a shaft drivingly connected to each of the sprockets and a power transfer assembly for imparting rotary motion to the shaft.

5. The adjustable shelving assembly according to claim 4, wherein the power transfer assembly comprises a manually rotatable element.

6. The adjustable shelving assembly according to claim 5, further comprising: means for selectively locking the rotatable element in a desired position.

7. The adjustable shelving assembly according to claim 5, wherein the manually rotatable element comprises a crank including a handle portion which is pivotable, relative to the shelf, between an in-use position and a retracted position.

8. The adjustable shelving assembly according to claim 7, further comprising: a platform supported upon the frame in a generally horizontal plane, wherein the platform is slidable relative to the frame.

9. The adjustable shelving assembly according to claim 8, further comprising: means for positively aligning the handle portion of the crank in at least one predetermined position relative to the sliding platform when the handle portion is in the retracted position.

10. The adjustable shelving assembly according to claim 4, wherein the power transfer assembly comprises a motor which is mounted to the shelf and adapted to receive electrical power, at least in part, through at least one of the rails.

11. The adjustable shelving assembly according to claim 4, wherein the power transfer assembly incorporates a worm gear drive unit.

12. The adjustable shelving assembly according to claim 3, further comprising at least one shift limiting member attached to said shelf, said at least one shift limiting member being adapted to engage at least one of said rails to prevent inadvertent disengagement between said sprockets and said rails.

13. An adjustable shelving assembly for a cabinet comprising:

a pair of support rails adapted to be positioned in a laterally spaced, generally vertically extending configuration within the cabinet, each of the support rails having terminal end portions and an associated longitudinal axis;

a shelf including a frame adapted to support a platform in a generally horizontal plane, with the shelf having fore-to-aft spaced, first and second end portions, said shelf being mounted for longitudinal movement upon said rails; and means for longitudinally shifting the shelf along the rails to selectively adjust the vertical position of the shelf within the cabinet, said shifting means including an electric motor secured to the shelf, said motor receiving electrical power, at least in part, through at least one of said rails.

14. The adjustable shelving assembly according to claim 13, further comprising an electrically conductive power supply strip affixed to the at least one of said rails and an electrical contact attached to the shelf, wherein the contact electrically engages the power supply strip in order to transmit electricity to said motor.

15. The adjustable shelving assembly according to claim 14, further comprising a pair of channel defining members secured to the second end portion of the shelf, each of the channel defining members extending about a portion of a respective one of the rails, wherein the contact is secured to one of the channel defining members.

16. An adjustable shelving assembly for a cabinet comprising:

a pair of support rails adapted to be positioned in a laterally spaced, generally vertically extending configuration within the cabinet, each of the support rails having terminal end portions and an associated longitudinal axis;

a shelf including a frame adapted to support a platform in a generally horizontal plane, with the shelf having fore-to-aft spaced, first and second end portions;

a pair of laterally spaced sprockets rotatably supported by the second end portion of said shelf, with each of said sprockets being adapted to be interengaged with a respective one of said rails to interengage said shelf and said rails while permitting longitudinal movement of the shelf along the rails upon rotation of said sprockets; and at least one shift limiting member attached to said shelf, for relative movement said at least one shift limiting member being adapted to engage at least one of said rails to prevent excessive tilting of the shelf from the horizontal plane, thereby avoiding inadvertent disengagement between said sprockets and said rails.

17. The adjustable shelving assembly according to claim 16, farther comprising a pair of channel defining members secured to the second end portion of the shelf, each of the channel defining members extending about a portion of a respective one of the rails.

18. The adjustable shelving assembly according to claim 17, further comprising a mechanism, connected to said sprockets, for longitudinally shifting the shelf along the rails, without entirely disconnecting the second end portion of the shelf from the rails, to selectively adjust the vertical position of the shelf within the cabinet.

19. The adjustable shelving assembly according to claim 18, further comprising means for selectively locking the mechanism for longitudinally shifting the shelf along the rails in a desired position.

20. The adjustable shelving assembly according to claim 18, wherein said mechanism for longitudinally shifting the shelf along the rails includes a shaft drivingly connected to each of the sprockets and a power transfer assembly for imparting rotary motion to the shaft.

21. The adjustable shelving assembly according to claim 20, wherein the power transfer assembly comprises a manually rotatable element.

22. The adjustable shelving assembly according to claim 21, wherein the manually rotatable element comprises a crank including a handle portion which is pivotable, relative to the shelf, between an in-use position and a retracted position.

23. The adjustable shelving assembly according to claim 22, further comprising: a platform supported upon the frame in a generally horizontal plane, wherein the platform is slidable relative to the frame.

24. The adjustable shelving assembly according to claim 23, further comprising: means for positively aligning the handle portion of the crank in at least one predetermined position relative to the sliding platform when the handle portion is in the retracted position.

25. The adjustable shelving assembly according to claim 20, wherein the power transfer assembly comprises a motor which is mounted to the shelf and adapted to receive electrical power, at least in part, through at least one of the rails.

26. A unitary rail for use, in combination with a similarly constructed rail, in supporting independent and differently constructed shelves at various vertical positions within a cabinet comprising: first and second rail sections, with each of the first and second rail sections being adapted to be arranged in a generally vertically extending manner within the cabinet with the first rail section being arranged juxtaposed to the second rail section, wherein the first rail section is adapted to support a first one of the differently constructed shelves in a first manner and the second rail section is adapted to support a second one of the differently constructed shelves in a second manner, while accommodating vertical shifting of the second one of the differently constructed shelves along the second rail section without completely disengaging the second one of the differently constructed shelves from the second rail section.

27. The unitary rail according to claim 26, wherein the first rail section extends generally parallel to the second rail section.

28. The unitary rail according to claim 27, wherein the first and second rail sections define respective longitudinal planes which are offset from one another.

29. The unitary rail according to claim 26, further comprising a plurality of vertically spaced and vertically extending slots formed in the first rail section and a plurality of vertically spaced and horizontally extending slots formed in the second rail section.

30. An adjustable shelving assembly for a cabinet comprising:

a pair of support rails adapted to be positioned in a laterally spaced, generally vertically extending configuration within the cabinet, each of the support rails having terminal end portions and an associated longitudinal axis, the support rails being similarly constructed, with each of the support rails being constituted by a unitary rail for use in supporting differently constructed shelves at various vertical positions within the cabinet, each of the rails including first and second rail sections, with each of the first and second rail sections being adapted to be arranged in a generally vertically extending manner within the cabinet with the first rail section being arranged juxtaposed to the second rail section, wherein the first rail section is adapted to support a first one of the differently constructed shelves in a first manner and the second rail section is adapted to support a second one of the differently constructed shelves in a second manner, while accommodating vertical shifting of the second one of the differently constructed shelves along the second rail section;

a shelf including a frame adapted to support a platform in a generally horizontal plane, with the shelf having fore-to-aft spaced, first and second end portions;

means for connecting the second end portion of the shelf upon the second rail sections of said rails while permitting longitudinal movement of the shelf along the rails, said connecting means including a pair of laterally spaced sprockets rotatably supported by the second end portion of said shelf with each of said sprockets being adapted to be interengaged with a respective one of said rails to interengage said shelf and said rails while permitting longitudinal movement of the shelf along the rails upon rotation of said sprockets, said connecting means enabling the shelf to be initially attached to said rails at a multitude of positions between the terminal end portions of said rails;

at least one shift limiting member attached to said shelf, said at least one shift limiting member being adapted to engage at least one of said rails to prevent excessive tilting of the shelf from the horizontal plane, thereby avoiding inadvertent disengagement between said sprockets and said rails; and means for longitudinally shifting the shelf along the rails, without entirely disconnecting the second end portion of the shelf from the rails, to selectively adjust the vertical position of the shelf within the cabinet, said shifting means including an electric motor secured to the shelf, said motor receiving electrical power, at least in part, through at least one of said rails.

31. A refrigerator cabinet incorporating an adjustable shelving assembly comprising:

a refrigerator cabinet compartment defined by top, bottom, rear and opposing side walls;

a pair of support rails mounted in a laterally spaced, generally vertically extending configuration within the cabinet, each of the support rails having terminal end portions and an associated longitudinal axis;

a shelf including a frame supporting a platform in a generally horizontal plane, with the shelf having fore-to-aft spaced, first and second end portions, with the second end portion of the shelf being supported by said rails in a cantilevered manner while permitting longitudinal movement of the platform relative to the rails, said shelf being initially engageable with said rails at a multitude of positions between the terminal end portions of said rails; and a gearing mechanism for longitudinally shifting the platform relative to the rails, without disconnecting the second end portion of the shelf from the rails, to selectively adjust the vertical position of the platform within the cabinet, said mechanism including a manually rotatable member extending forward of the first end portion of the shelf.

32. The refrigerator cabinet according to claim 31, wherein the manually rotatable member comprises a crank arm.

33. The refrigerator cabinet according to claim 32, wherein the crank arm extends forward of the shelf at a substantially central section of the first end portion.

* * * * *